United States Patent [19]

Fisk et al.

[11] Patent Number: 4,733,676

[45] Date of Patent: Mar. 29, 1988

[54] SLICED BALE CONDITIONING

[75] Inventors: Cedric J. Fisk, Chard; Edward J. Allen, Andover, both of England

[73] Assignee: W. H. Dickinson Engineering Limited, Winchester, England

[21] Appl. No.: 857,328

[22] Filed: Apr. 30, 1986

[51] Int. Cl.[4] ..... A24B 7/12; A24B 7/14; A24B 3/04

[52] U.S. Cl. ..... 131/290; 131/306; 131/327; 131/305

[58] Field of Search ..... 131/327, 290, 304, 305, 131/306, 307

[56] References Cited

U.S. PATENT DOCUMENTS

| | | | |
|---|---|---|---|
| 4,222,397 | 9/1980 | Brackmann et al. | 131/306 |
| 4,554,933 | 11/1985 | Neville | 131/306 |
| 4,573,484 | 3/1986 | Ruffer et al. | 131/327 |
| 4,597,396 | 7/1986 | Holt et al. | 131/327 |

FOREIGN PATENT DOCUMENTS

| | | |
|---|---|---|
| 0069126 | 1/1983 | European Pat. Off. . |
| 0095866 | 12/1983 | European Pat. Off. . |
| 0101271 | 2/1984 | European Pat. Off. . |
| 82/02324 | 7/1982 | PCT Int'l Appl. . |

*Primary Examiner*—V. Millin
*Assistant Examiner*—H. Macey
*Attorney, Agent, or Firm*—Lee, Smith & Zickert

[57] ABSTRACT

Apparatus for slicing tobacco bales for conditioning in which the bales are moved from a conveyor (2) onto an adjacent lift device (16) by a first pusher (6), and are then sliced by a slicing blade (20) which is moved horizontally into engagement with the top of the bale and slices the bale while the lift device is dropped slightly to assist in cleaving the bale. The lift is then actuated to raise the bale ready for the next slicing operation, after the previous slice has been ejected by a second pusher (22).

5 Claims, 4 Drawing Figures

SLICED BALE CONDITIONING

This invention relates to apparatus for treating tobacco bales by slicing them into slices of controlled thickness, to facilitate subsequent conditioning of the tobacco. It also relates to a conditioning unit particularly adapted for use with the slicing apparatus of the invention.

Apparatus according to the invention, for slicing tobacco bales and feeding them to a subsequent processing stage, comprises a conveyor, a lift device arranged adjacent the conveyor, and means for moving a bale from the conveyor onto the lift device; at least one slicing blade arranged adjacent the lift device, so as to engage the upper portion of a bale placed thereon; means for advancing the blade so as to cut a horizontal slice from the top of the bale; and means for ejecting the slice after it has been cut.

Preferably, the means for moving the bale, and the means for moving the cut slice off the top of the bale are both pusher devices, and the apparatus preferably includes control means adapted to synchronise the operation of the apparatus in such a way that the slicer blade is retracted whilst the slice is being ejected, and the lift is then actuated to raise the bale by the height of a further slice; the arrangement being such that the slice pusher is adapted to ride over the top of the bale, as it is moved to its retracted position in preparation for engagement with the next slice. Alternatively the slice pusher may be so arranged that on its return stroke, it is lifted clear of the bale by pneumatic or similar means.

One known method of slicing bales uses four opposing blades acting in the same plane and travelling towards and meeting in the centre of the bale. However this can cause excessive degradation of the tobacco leaf since the leaf strata can deviate either below or above the shear plane. The tendency is for the product to be subjected to a tearing action as the four blades approach each other.

The apparatus of the present invention preferably uses only one blade constrained to cut in a horizontal plane. In addition to the action of the blade the lifting device is automatically lowered slightly by the control means as the blade enters the bale enabling the bale to shear along the cutting plane in advance of the blade thus assisting cleavage to occur naturally in the same plane as the strata of lamina in the bale.

A further aspect of the invention provides a tobacco conditioning device, particularly adapted for use with the slicing apparatus of the invention, and comprising at least one cylinder which is rotatable about an axis which is inclined downwardly from the feed end to the delivery end.

The cylinder may include inwardly directed projections, at the feed end, adapted to break off predetermined lengths of the bale slices, as they enter the cylinder from the slicing apparatus. The projections may, for example, be in the form of helical blades, or pins.

Preferably, the conditioner comprises a pair of cylinders arranged in series, the downstream cylinder being of larger diameter than the upstream cylinder so that each of them may have an optimum diameter relative to the volumetric flow of tobacco, which, of course, increases as it is gradually opened out, during its passage through the conditioner.

The conditioner preferably also incorporates steam and/or water sprays at the feed end, and in the case of an arrangement including two cylinders there may be additional sprays at their junction.

Some embodiments of the invention will now be described by way of example, with reference to the accompanying drawings in which.

Figure 1:
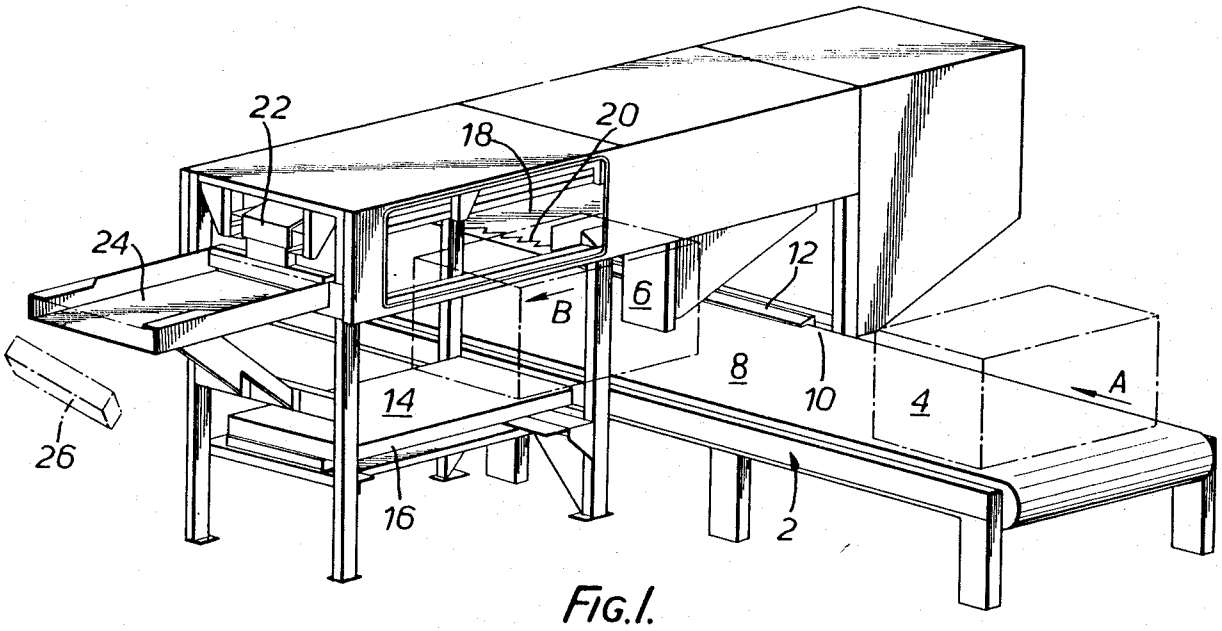
FIG. 1 shows an isometric perspective view of a first type of slicing device in accordance with the invention.

Referring to FIG. 1, the apparatus includes a conveyor generally indicated at 2, and a bale 4 to be sliced is placed on one end of the conveyor, so as to be fed in the direction of the arrow A. A pusher 6 is initially positioned to the right of the conveyor run, as seen in the direction of movement, and the bale is stopped when it is adjacent this pusher. The outer edge 10 of the conveyor band 8 is then clamped by means of a clamping device 12, and the pusher is actuated to move the bale in the direction of arrow B.

This action pushes the bale off the conveyor band, onto the platform 14 of a scissor lift 16. The lift is then raised in suitable increments, to allow slices of desired thicknesses to be cut, in the following manner:

When the first incremental movement has taken place, a slicer blade 18 which may have a plain edge, chevron, saw tooth, or sinusoidally shaped leading edge 20, is also advanced in the direction of arrow B so as to slice through the top portion of the bale. The slice is then left resting on the top surface of the blade.

A further pusher device, which is initially positioned approximately in line with the starting position of the blade 18, is then actuated to remove the slice from the top of the blade, and dispense it onto a chute 24 forming the outlet of the device, and hence into the cylinder.

Whilst the pusher is moving forward in this mode, the slicer blade 18 is quickly retracted so as to allow the scissor lift 16 to be raised by another increment, and as soon as the previously cut slice has been fully fed into the conditioner the pusher 22 is retracted, its front end being adapted to lift and ride over the newly raised top surface of the bale. A further slice can then be cut and the feed sequence repeated until the final portion of the bale has reached the required height, when, of course, the blade is not required to operate, but instead the final slice is simply fed onto the chute by the pusher 22.

Figure 2:
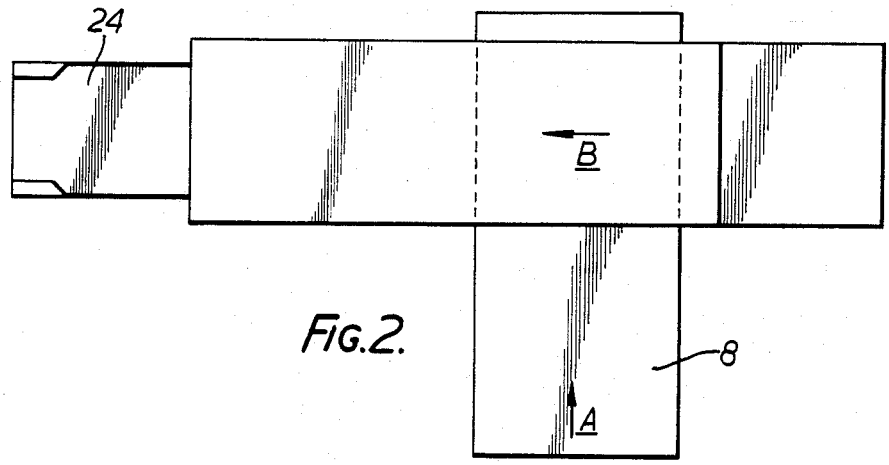
FIG. 2 shows a diagrammatic plan view of the device of FIG. 1.
Figure 3:
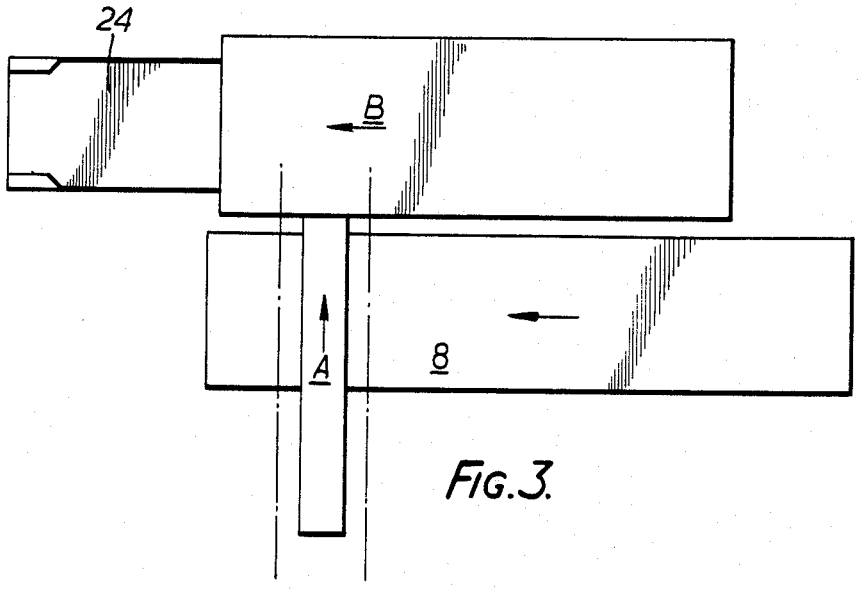
FIG. 3 shows a diagrammatic plan view of an alternative form of the device of FIG. 1.

In the arrangement of FIGS. 1 and 2, the bale slices are pushed away from the lift device 16, in a direction at right angles to the movement of the conveyor 8, that is to say in the same direction as the direction of movement of the pusher 6 which moves the bale from the conveyor onto the lift. However, it will be appreciated that, where circumstances dictate a different arrangement, the layout of FIG. 3 (for example) may be used, in which the outlet chute 24 is oriented in a direction parallel to the conveyor 8, so that the movement of the pusher 22 is also in a direction parallel to the conveyor.

Figure 4:
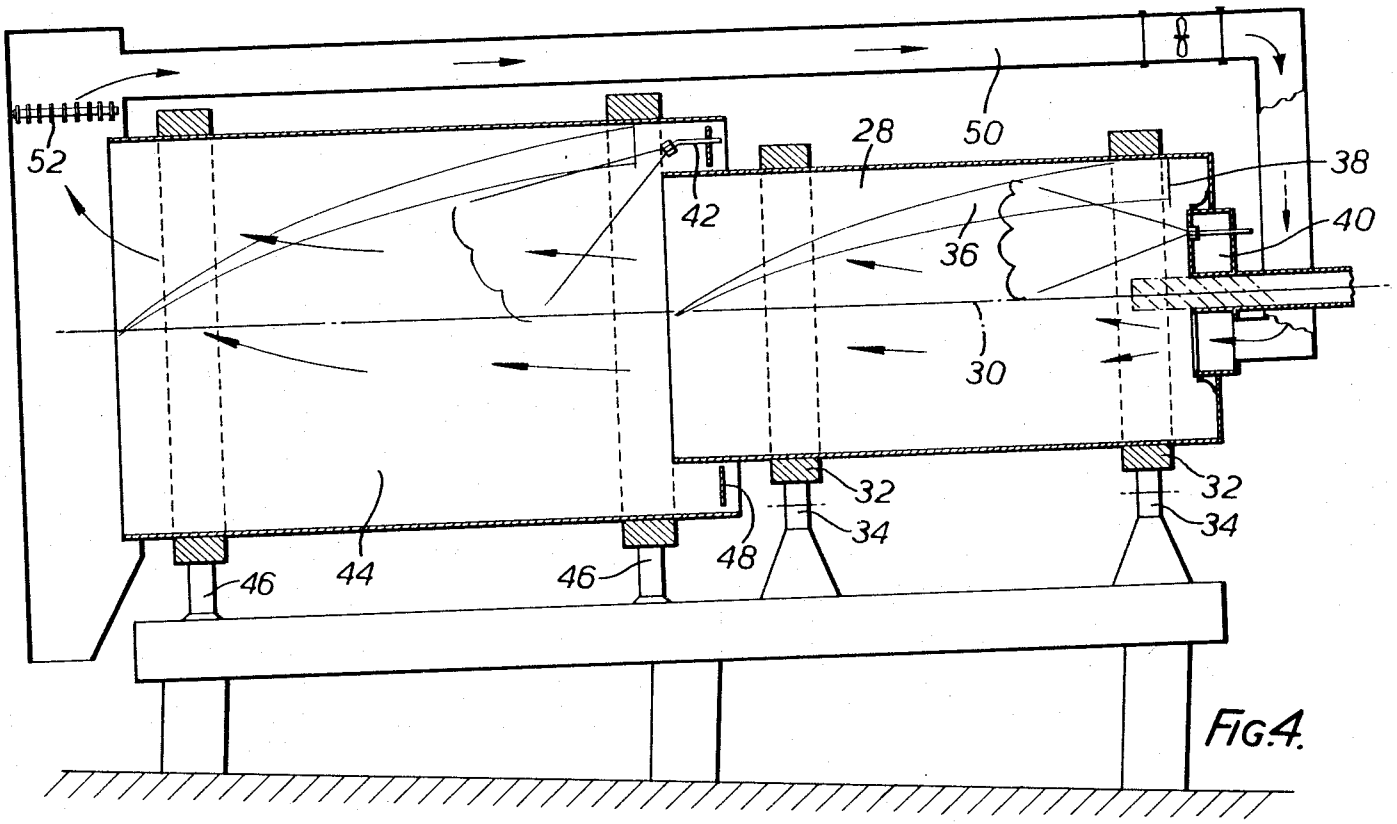
FIG. 4 shows a diagrammatic vertical cross section through a conditioning device for use with the slicing apparatus of FIGS. 1 and 2 or FIG. 3.

Referring now to FIG. 4, this shows a conditioning cylinder system, adapted to receive and condition the slices cut by the apparatus described above with reference to the previous figures. The conditioning apparatus includes a first cylinder 28, mounted for rotation about a slightly inclined axis 30, by means of track rings 32 and cooperating support rollers 34, and having longitudinally extending rows of helical blades 36, whose leading ends 38 are positioned adjacent the feed inlet end of the cylinder, so that the slices are broken up as they enter the cylinder. The blades also act, in conjunction with the "moisturising" or "conditioning" action of the device, to open up the slices into separated pieces of tobacco leaf.

Steam and water sprays 40 are also positioned at the feed end, and in the arrangement shown, which is a "two stage" device having twin cylinders, additional sprays 42 are also fitted at the junction of the two cylinders.

The second cylinder 44, which is also rotatably mounted on support rollers 46, is larger in diameter than the cylinder 28, so as to allow optimum treatment of the tobacco, after its volume has been initially expanded by the first stage of conditioning in cylinder 28. The additional sprays 42 are mounted in a static annular plate 48, which seals the junction between the two rotating cylinders.

Air is circulated through the device, by means of a duct 50, whose inlet is at the delivery end of the second cylinder 44, and includes a heat exchanger 52, to aid in warming up the system to working temperature on start-up. The control of temperature during the remainder of the process, is achieved purely by regulating the input of steam via the spray nozzles 40 or 42.

The adoption of this two stage configuration provides a number of advantages, in that additional steam and water sprays may be positioned, as shown, at the junction of the cylinders, and if desired, process air may also be injected at this point. In addition, the rotational speed of the two cylinders may be different, and may be adjusted in each case, to suit the particular state of the product at each point. Using these methods, it may be possible to raise the moisture content of the product from 10% to as much as 20%.

What is claimed is:

1. Apparatus for slicing and processing tobacco bales, comprising a conveyor (2), a lift device (16) arranged adjacent the conveyor, first means (6) for moving a bale from the conveyor onto the lift device; at least one slicing blade (20) arranged adjacent the lift device, so as to engage the upper portion of a bale placed thereon; means for advancing the bale so as to cut a horizontal slice from the top of the bale; second means (22) for ejecting the slice after it has been cut; and control means arranged to retract the slicer blade whilst the slice is being ejected, and to then actuate the lift to raise the bale by the height of a further slice whilst the second means is retracted over the top of the bale in preparation for its engagement with the next slice, the control means also being arranged to lower the lifting device slightly, as the blade enters the bale on its cutting stroke, so as to assist the shearing of the bale along the cutting plane, in advance of the blade.

2. Apparatus according to claim 1 in which the means for moving the bale from the conveyor onto the lift device comprises a first pusher member (6), and the means for moving the slice from the top of the bale comprises a second pusher member (22).

3. An apparatus according to claim 1, and further comprising a rotary cylinder conditioner for conditioning the slices of tobacco, the conditioner being arranged so that it receives slices from the slicer at a feed end and has an axis inclined downwardly to a delivery end.

4. An apparatus according to claim 3, further comprising a second cylinder arranged downstream of the first cylinder and having a larger diameter than the first.

5. An apparatus according to claim 3, in which the cylinder conditioner includes inwardly directed projections at the feed end, adapted to break up the slices as they leave the slicer.

* * * * *